United States Patent [19]

Mangus

[11] 4,367,628

[45] Jan. 11, 1983

[54] LOW CHEMICAL CONCENTRATING STEAM GENERATING CYCLE

[75] Inventor: James D. Mangus, Greensburg, Pa.

[73] Assignee: The United States of America as represented by the United States Department of Energy, Washington, D.C.

[21] Appl. No.: 238,774

[22] Filed: Feb. 27, 1981

[51] Int. Cl.[3] ..... F01D 17/00

[52] U.S. Cl. ..... 60/657; 60/646; 122/406 ST

[58] Field of Search ..... 122/406 R, 406 S, 406 ST; 60/644.1, 646, 657, 667

[56] References Cited

U.S. PATENT DOCUMENTS 3,580,223 5/1971 Knizia ..... 122/406 ST
3,789,806 2/1974 Gorzegno ..... 122/406 ST
4,087,985 5/1978 Cohen et al. ..... 60/644

FOREIGN PATENT DOCUMENTS 2840603 3/1980 Fed. Rep. of Germany ..... 122/406 ST

*Primary Examiner*—A. Michael Chambers
*Attorney, Agent, or Firm*—K. R. Bowers, Jr.; Z. L. Dermer

[57] ABSTRACT

A steam cycle for a nuclear power plant having two optional modes of operation. A once-through mode of operation uses direct feed of coolant water to an evaporator avoiding excessive chemical concentration buildup.

A recirculation mode of operation uses a recirculation loop to direct a portion of flow from the evaporator back through the evaporator to effectively increase evaporator flow.

1 Claim, 2 Drawing Figures

LOW CHEMICAL CONCENTRATING STEAM GENERATING CYCLE

GOVERNMENT CONTRACT

This invention was conceived during the performance of a contract with the United States Government designated DE-AC-14-79-ET-3717.

BACKGROUND OF THE INVENTION

This invention relates to a steam cycle used in power producing steam stations to convert heat energy to electricity.

The conversion of heat from a primary source such as a nuclear power reactor to usable electricity is accomplished by a variety of steam cycles. Many of these cycles produce high concentrations of impurities at locations in the cycle where water boiling occurs, a problem often solved by use of blowdown streams which continuously or intermittently discard or reprocess a portion of a fluid stream intended to contain the impurities. Blowdown systems are not considered energy efficient since the heat content of the blowdown flow is usually lost.

Consequently, it is an object of this invention to provide a steam cycle which avoids chemical impurity concentrations and minimizes energy loss.

SUMMARY OF THE INVENTION

The invented steam cycle is a combined cycle providing the flexibility to operate in a "once-through mode" or in a "recirculating mode". In this combined cycle, the plant operates in a once-through mode in the power range, thereby avoiding excessive chemical concentration, and operates as a fully recirculating unit for startup, shutdown, trips, etc. This combined cycle consists of one evaporator, one superheater, one steam separator vessel, one water storage vessel, and one recirculation pump in each loop. Feedwater enters a water storage tank, mixing with recirculated water from a steam separating drum. The feedwater then enters the evaporator as subcooled liquid and exits as steam with a maximum quality of 91 percent. The steam enters the steam separating vessel, whence 100 percent quality steam enters the superheater. It exits the superheater at 2275 psia and 855° F. The water separated from the steam exits the bottom of the steam vessel as either blowdown to the topping feedwater heater or as a recirculated stream to mix with incoming feedwater in the storage vessel.

DETAILED DESCRIPTION

Figure 1:
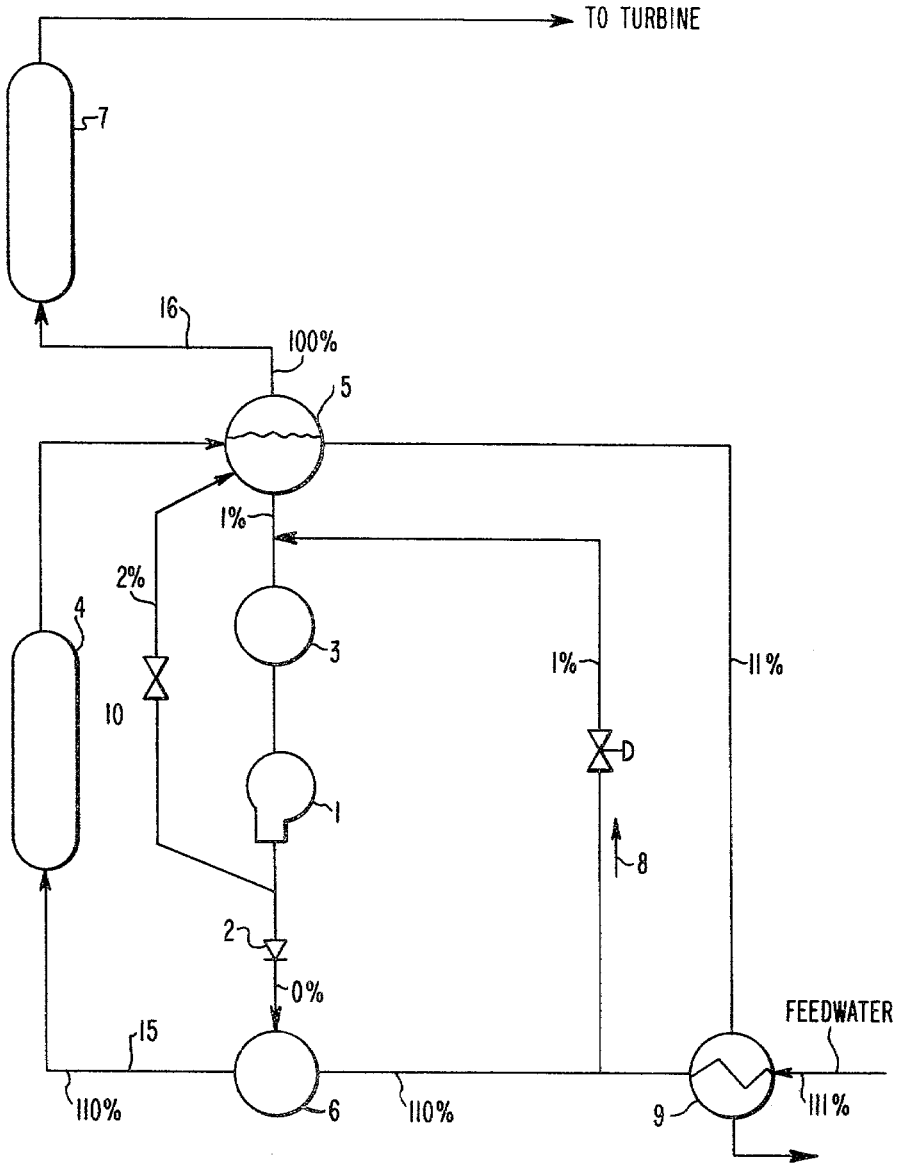
FIG. 1 is a schematic of the invented steam cycle in the once-through mode of operation.

Refer to FIG. 1, which shows the invented steam cycle in the once-through mode of operation. While in this mode, the circulation pump 1 speed is reduced to the point that the circulation line check valve 2 closes, eliminating all recirculation. Flow is continued through the circulation pump 1 to: (A) prevent pump overheating, (B) be on standby in the event of a loss of normal feedwater, and (C) to maintain the storage tank 3 temperature lower than the drum-separator 5 temperature but above the feedwater temperature. While in this mode, there is no chemical concentration of the evaporator 4 inlet feedwater, and the storage tank 3 water is maintained at a concentration less than the drum-separator 5 to prevent an impurity transient when converting to a recirculation mode.

In order to maintain the desired storage tank 3 temperature and to dilute the impurities removed in the separator 5, a small (assumed to be 1 percent) bypass flow 8 is directed from the main feedwater stream. This mixes with a like amount of water from the separator 5 and enters the storage tank 3. The flow from the storage tank 3 is returned to the separator 5 via the circulation pump 1, completing the circuit.

The main feedwater flows directly into the evaporator 4 where it is converted to 90 percent quality steam. Within the separator 5 the 10 percent moisture is removed and all the steam is transported to the superheater 7. The 10 percent water plus the previously discussed one percent bypass flow 8 are blown down through a topping heat recovery feedwater heater 9 through the low pressure feedwater heaters (not shown) and to the condenser (not shown). All flow from the condenser is through a full-flow demineralizer (not shown) to obtain the required feedwater purity.

Figure 2:
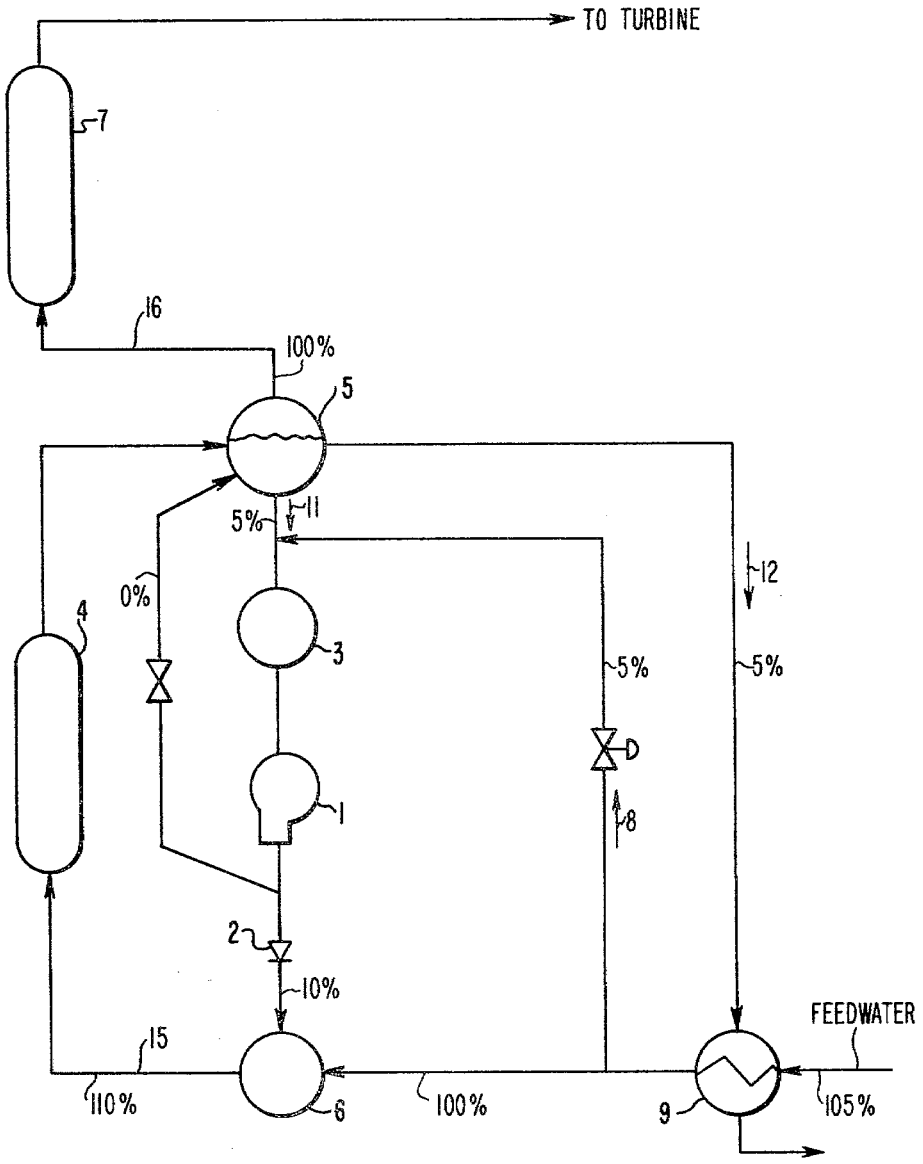
FIG. 2 is a schematic of the invented steam cycle in the recirculation mode of operation.

A schematic of the combined cycle, when operating in a recirculation mode is shown in FIG. 2. In a recirculating mode, the circulation pump 1 speed is increased to provide the circulation ratio desired. Taking as an example operating at the very low circulation ratio of 1.1:1, (the ratio of flow entering the evaporator, 15 to the steam flow, 16, FIG. 2) and with the steam leaving the separator 5 defined as 100 percent, the feedwater flow for this condition would be 105 percent. This flow is split, prior to entering the mixing tank 6, with 5 percent bypass going to the storage tank 3 and 100 percent to the mixing tank 6. The circulation pump 1 would be delivering 10 percent flow from the storage tank 3 to mix with the 100 percent feedwater giving 110 percent flow to the evaporator 4. The 10 percent circulation flow consists of the 5 percent bypass flow mixed with 5 percent flow coming from the steam separator 5. This is done in order to reduce the storage tank 3 temperature to somewhere between saturation and the feedwater temperature for transient considerations. Also, this serves to reduce the chemical concentration in the drum-separator 5 which is an advantage for load change chemical transients. The mixture leaving the evaporator 4 is at 90 percent quality to avoid hot tube superheating. The 10 percent moisture is removed in the drum-separator 5, one-half of the water (or 5 percent) is delivered to the storage tank 3 completing that circuit. The remaining water is blown down to the topping feed heater 9. The steam from the drum-separator 5 is then superheated and delivered to the turbine (not shown).

When operating in the recirculating mode just described, the concentration of impurities in the evaporator 4 inlet water is about two times that of the entering feedwater. Higher circulation ratios require greater blowdown for acceptable chemical concentrations. For example, at a 1.5:1 circulation ratio, 7 percent blowdown is required to maintain a concentration factor of five times the feedwater concentration (the preferred limit). This, however, is not a particular penalty for the cycle inasmuch as larger circulation ratios are expected to be used only for short periods of time during part load operations.

The turbine proposed for this cycle is a cross compound design with double flow high pressure (HP) and intermediate pressure (IP) elements on the 3600 RPM shaft and two double flow low pressure (LP) elements with 40 inch last row blades on the 1800 RPM shaft.

The provision of two modes of operation provides the flexibility needed to prevent impurity concentration when needed by operating in the once-through mode and to convert to a more desirable recirculating mode of operation when impurity concentration is not a problem.

The disclosed steam cycle can be modified without departure from the spirit and scope of the invention. Therefore, the specification should be interpreted as illustrative rather than limiting.

I claim:

1. A steam cycle for the generation of steam in a power generation station which comprises:

A. an evaporator;

B. a steam drum-separator in fluid contact with said evaporator;

C. a circulation pump disposed to remove a portion of fluid flow from said steam drum-separator and pump said portion back through said evaporator to said separator through a first flow path, operation of said circulation pump thereby constituting a recirculation mode of operation for said steam cycle and non-operation of said circulation pump constituting a closed mode of operation of said steam cycle;

and further comprising a second flow path allowing controlled flow from the discharge of said circulation pump directly to the steam separator without passing through said evaporator.

* * * * *